US007351013B2

(12) United States Patent
Anderson

(10) Patent No.: US 7,351,013 B2
(45) Date of Patent: Apr. 1, 2008

(54) UNITARY PILE JACKING SLEEVE FOR INSTALLING AND COMPRESSIVELY LOADING PILING WITHOUT OVERHEAD ACCESS AND WITHOUT DISRUPTING A SUPER-STRUCTURE

(76) Inventor: Scott Anderson, 5731 St Augustine Rd., Jacksonville, FL (US) 32207

( * ) Notice: Subject to any disclaimer, the term of this patent is extended or adjusted under 35 U.S.C. 154(b) by 39 days.

(21) Appl. No.: 11/164,454

(22) Filed: Nov. 23, 2005

(65) Prior Publication Data

US 2006/0245832 A1 Nov. 2, 2006

Related U.S. Application Data

(60) Provisional application No. 60/594,660, filed on Apr. 27, 2005.

(51) Int. Cl.
*E02D 5/64* (2006.01)

(52) U.S. Cl. ..... 405/232; 405/216; 405/251

(58) Field of Classification Search ..... 405/231, 405/232, 250, 251, 216
See application file for complete search history.

(56) References Cited

U.S. PATENT DOCUMENTS

| | | | | |
|---|---|---|---|---|
| 1,073,614 | A * | 9/1913 | McDearmid | 405/251 |
| 2,222,481 | A * | 11/1940 | Ferguson et al. | 405/251 |
| 3,201,834 | A * | 8/1965 | Baittinger | 405/251 |
| 4,537,534 | A * | 8/1985 | Marsh, Jr. | 405/251 |
| 5,813,800 | A * | 9/1998 | Doleshal | 405/251 |
| 6,551,030 | B1 * | 4/2003 | Curry | 405/251 |

* cited by examiner

*Primary Examiner*—Frederick L. Lagman
(74) *Attorney, Agent, or Firm*—Mark Young, P.A.

(57) ABSTRACT

A pile jacking sleeve includes a structural sleeve having a bottom section, an intermediate section and a top section. A stationary plate partitions the bottom section from the top section. A floating plate separates the intermediate section from the top section. A hinged door at the top section allows lateral entry of a piling into the top section when the door is open. An aperture allows insertion and removal of at least one jack into the intermediate section. Actuation of the jack urges the floating plate away from the stationary plate, controllably imparting a load to installed piling. A plurality of bolt holes are also provided in the sleeve to secure piling thereto. The sleeve may be jacketed for additional protection. A plurality of grout windows are also provided in the sleeve to enable filling the structure with a solidifying filler.

13 Claims, 6 Drawing Sheets

OPTIONAL PILE ENCASEMENT DETAIL

PILE JACKING SLEEVE SQUARE GEOMETRY

OPTIONAL PILE ENCASEMENT DETAIL

UNITARY PILE JACKING SLEEVE FOR INSTALLING AND COMPRESSIVELY LOADING PILING WITHOUT OVERHEAD ACCESS AND WITHOUT DISRUPTING A SUPER-STRUCTURE

RELATED APPLICATION

This application claims the benefit of priority to U.S. Provisional Application No. 60/594,660 filed Apr. 27, 2005, the entire contents of which are incorporated herein and made a part hereof.

FIELD OF THE INVENTION

This application relates to piling repairs and, more specifically, to a unitary pile jacking sleeve adapted for installing and compressively loading new piling without overhead access and without disrupting a deck structure/super-structure.

BACKGROUND

Pilings of concrete, timber, steel or composite materials are an integral structural part of marine structures, such as bridges, docks, piers and wharves. Pilings, which are driven or jetted into the ground to some determined depth, support a structure above the water's surface. For convenience of reference, the term "ground" is used herein to broadly denote any terrain suitable for supporting a piling, whether it is above water or below water, whether it is natural or man-made, and whether it is comprised sand, rocks, soil, other materials and combinations thereof.

Unfortunately, the exposure of piling makes them susceptible to degradation. Wood pilings are particularly prone to deterioration from biological infestation as well as structural damage due to overloading, impact, and abrasion. Steel pilings are prone to damage by corrosion and structural overloading and impact. Concrete pilings deteriorate chemically with time and experience structural degradation due to overloading, impact, abrasion and freeze-thaw cycling. A damaged piling typically includes a deteriorated section above or below the soil line that compromises the ability of the piling to support its intended design load.

While various encasement, wrapping and replacement techniques have emerged to repair such inevitable damage, these techniques have shortcomings. Encasement and wrapping are suitable if the damage has not seriously compromised the structural integrity of the piling. To repair more serious damage, a section of a piling may have to be replaced or the piling may have to be replaced in its entirety. However, conventional replacement techniques (e.g., techniques requiring a crane and pile driving leads) typically require dismantling a portion of the deck structure/superstructure and replacing and loading a damaged section of piling or installing and loading a new piling. Other techniques require complex arrangements of separate couplings to splice in a new pile section. No known techniques provide means for compressively loading a replacement section of pile or installing a new two-piece pile to design specifications.

As a consequence of the foregoing, there exists a longstanding need for a new and improved system and method for efficiently replacing and loading a damaged section of piling and/or installing and loading new piling. The system and method should enable replacement without dismantling the supported deck structure/super-structure. Additionally, the system should be relatively easy to use and have relatively few separate components (i.e., preferably a unitary component) to facilitate above water, splash zone and underwater application. Furthermore, the system should enable compressively loading a replacement pile to proper design specifications. Moreover, the system should work with various types of pilings of various cross-sectional shapes.

The invention is directed to overcoming one or more of the problems and fulfilling one or more of the needs as set forth above.

SUMMARY OF THE INVENTION

To overcome one or more of the problems and fulfill one or more of the needs as set forth above, in one aspect of an exemplary embodiment of the invention, a unitary pile jacking sleeve is provided. The sleeve has a bottom sleeve section, an intermediate sleeve section and a top sleeve section. The bottom sleeve section, intermediate sleeve section and top sleeve section are adapted to structurally support a design load. The bottom sleeve section has an open bottom end and a top end attached to the intermediate section, and the bottom section is adapted to receive through the open bottom end of the bottom section the top end of a bottom pile that has a bottom end secured in the ground. The top sleeve section has an open top end and a bottom end attached to the intermediate section. The top section is adapted to receive the bottom end of a top pile that extends from the open top end to a supported structure. The design load is greater than the weight of the top pile. The intermediate sleeve section being disposed between and adjoining the top sleeve section and the bottom sleeve section.

In another aspect of an exemplary implementation of the invention, the top sleeve section includes means for enabling lateral (i.e., horizontal) access to the top sleeve section by the top pile. As one example, such means may include a hinged door adapted for enabling lateral (i.e., horizontal) access to the top sleeve section by the top pile.

In another aspect of an exemplary implementation of the invention, a stationary plate partitions the bottom sleeve section from the intermediate sleeve section, and a floating plate separates the intermediate section from the top section, In another aspect of an exemplary implementation of the invention, an aperture provided in the intermediate sleeve section is adapted for allowing insertion and removal of at least one jack into the intermediate sleeve section.

In another aspect of an exemplary implementation of the invention, a plurality of fastener apertures are provided in the pile jacking sleeve. The fastener apertures are adapted to allow mechanical fasteners to pass therethrough.

In another aspect of an exemplary implementation of the invention, a plurality of filler apertures are provided in the pile jacking sleeve. The filler apertures are adapted to allow filler material to pass therethrough.

In another aspect of another exemplary implementation of the invention, a bottom sleeve section, an intermediate sleeve section and a top sleeve section are provided. The bottom sleeve section, intermediate sleeve section and top sleeve section are adapted to structurally support a design load. The bottom sleeve section has an open bottom end and a top end attached to the intermediate section. The bottom section is adapted to receive through the open bottom end of the bottom section the top end of a bottom pile that has a bottom end secured in the ground. The top sleeve section has an open top end and a bottom end attached to the intermediate section. The top section is adapted to receive the bottom end of a top pile that extends from the open top end to a supported structure. The design load is greater than the weight of the top pile. The top sleeve section further includes means for enabling lateral (i.e., horizontal) access to the top sleeve section by the top pile.

In another aspect of another exemplary implementation of the invention, the means for enabling lateral (i.e., horizontal) access to the top sleeve section by the top pile is comprised of a hinged door adapted for enabling lateral (i.e., horizontal) access to the top sleeve section by the top pile.

In another aspect of another exemplary implementation of the invention, a stationary plate partitions the bottom sleeve section from the intermediate sleeve section, and a floating plate separates the intermediate section from the top section.

In another aspect of another exemplary implementation of the invention, an aperture in the intermediate sleeve section allows insertion and removal of at least one jack into the intermediate sleeve section.

In another aspect of another exemplary implementation of the invention, a plurality of fastener apertures are provided in the pile jacking sleeve. The fastener apertures are adapted to allow mechanical fasteners to pass therethrough.

In another aspect of another exemplary implementation of the invention, a plurality of filler apertures are provided in the pile jacking sleeve. The filler apertures are adapted to allow filler material to pass therethrough.

In another aspect of another exemplary implementation of the invention, at least one jack is disposed between the stationary plate and the floating plate, and configured to enable urging the floating plate away from the stationary plate.

In another aspect of another exemplary implementation of the invention, a jacket surrounds the intermediate sleeve section, top sleeve section, and bottom sleeve section.

In another aspect of another exemplary implementation of the invention, a solidifying filler is provided between the jacket and the intermediate sleeve section, top sleeve section, and bottom sleeve section.

In another aspect of yet another exemplary implementation of the invention, a method of repairing a pile using a pile jacking sleeve according to principles of the invention is provided. The method includes sliding the bottom sleeve section down along the bottom pile until the stationary plate rests securely on top of the bottom pile; opening the means for enabling lateral access to the top sleeve section by the top pile; maneuvering the bottom end of the top pile laterally into place through the opened means for enabling lateral access until the bottom end of the top pile rests upon the floating plate; exerting a compressive force against the floating plate to urge the floating plate away from the stationary plate until a determined compressive force is exerted onto the entire pile; and securing the top pile to the top section of the pile jacking sleeve after the determined compressive force is reached. The method may further include encasing the pile jacking sleeve in an encasement and solidifying filler.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale. The invention is not limited to the exemplary embodiments depicted in the figures or the shapes, relative sizes, proportions or materials shown in the figures.

DETAILED DESCRIPTION

One exemplary methodology according to principles of the invention entails removing a damaged upper elevation of a piling by cutting. The damaged section up to the pile cap may be removed. As piling are typically designed to hold several times the weight of a supported pier and structures thereon, damaged sections may typically be removed one at a time, without endangering the stability of the pier or supported structures. Nevertheless, temporary supports (e.g., a crane/false work) may be utilized throughout the repair, out of an abundance of caution, to ensure structural integrity.

Figure 1:
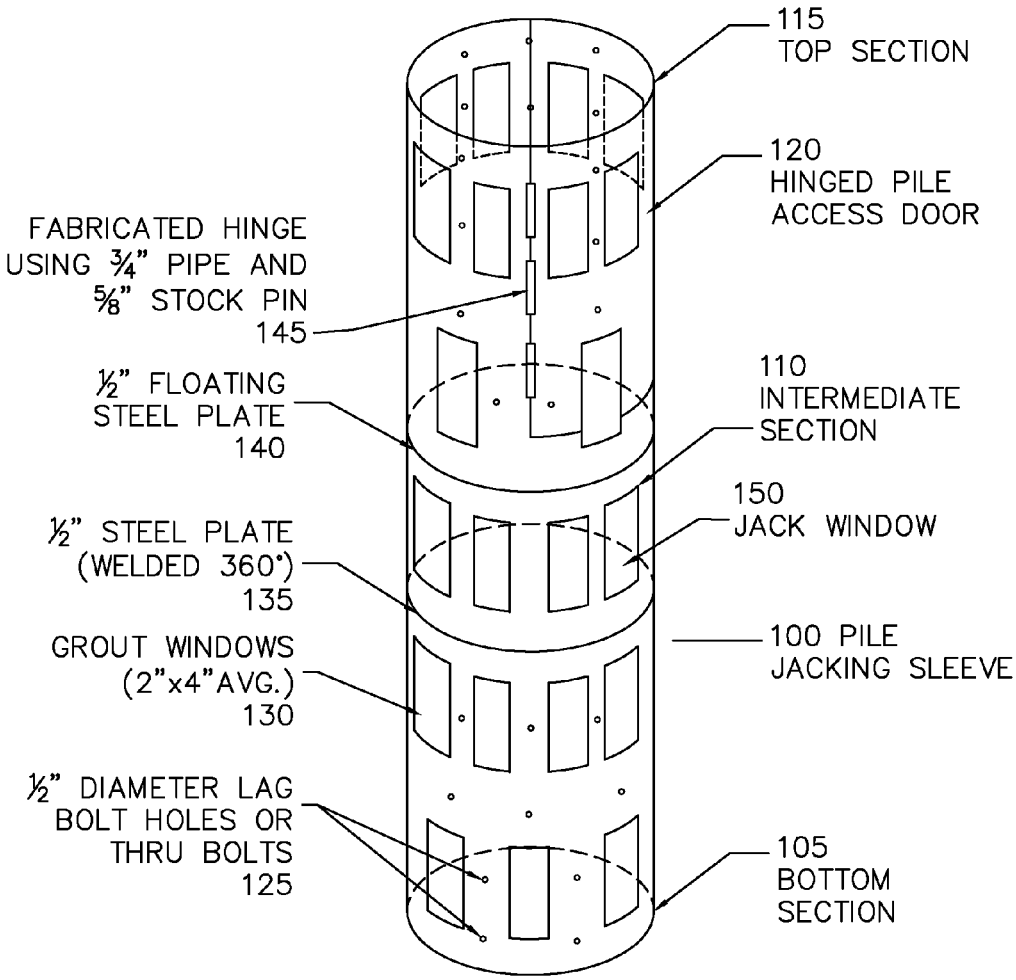
FIG. 1 is a perspective view of an exemplary cylindrical pile jacking sleeve according to principles of the invention.

Next an exemplary pile jacking sleeve according to principles of the invention is installed. Referring to FIG. 1, a perspective view of an exemplary cylindrical pile jacking sleeve 100 is shown. The sleeve 100 includes a bottom section 105, an intermediate section 110 and a top section 115.

As a structural member, the sleeve 100 is designed to be at least as strong as the piling. The sleeve can support the weight of the top section of the piling plus the load that the piling was intended to carry. By way of illustration, without limitation, cylindrical sleeves comprised of steel and having a consistent wall thickness of ¼ to 1 inch (or more) is considered adequate for most applications. Of course, the composition and wall thickness may vary while still providing the requisite structural support and without departing from the scope of the invention.

The sleeve 100 is sized to engage the piling sections. The cylindrical sleeve 100 has an inner diameter that is about slightly larger than the outer diameter of the piling sections.

The sleeve includes a plurality of apertures. A plurality of bolt holes 125 are provided to receive bolts or other mechanical fasteners for securing the sleeve to the remaining sections of the piling or new piling. A plurality of optional grout windows 130 are also provided to allow grout to fill the gap between the sections of the piling, between the piling and the sleeve and between the sleeve and an optional jacket. While the windows are displayed as rectangular openings, apertures having other shapes, sizes and proportions may be used. Additionally, at least one window 150 (or a hinged or bolted door) in the intermediate section 110 sized to allow one or more hydraulic jacks to be inserted and removed from the intermediate section 110 of the sleeve is also provided.

Figure 3:
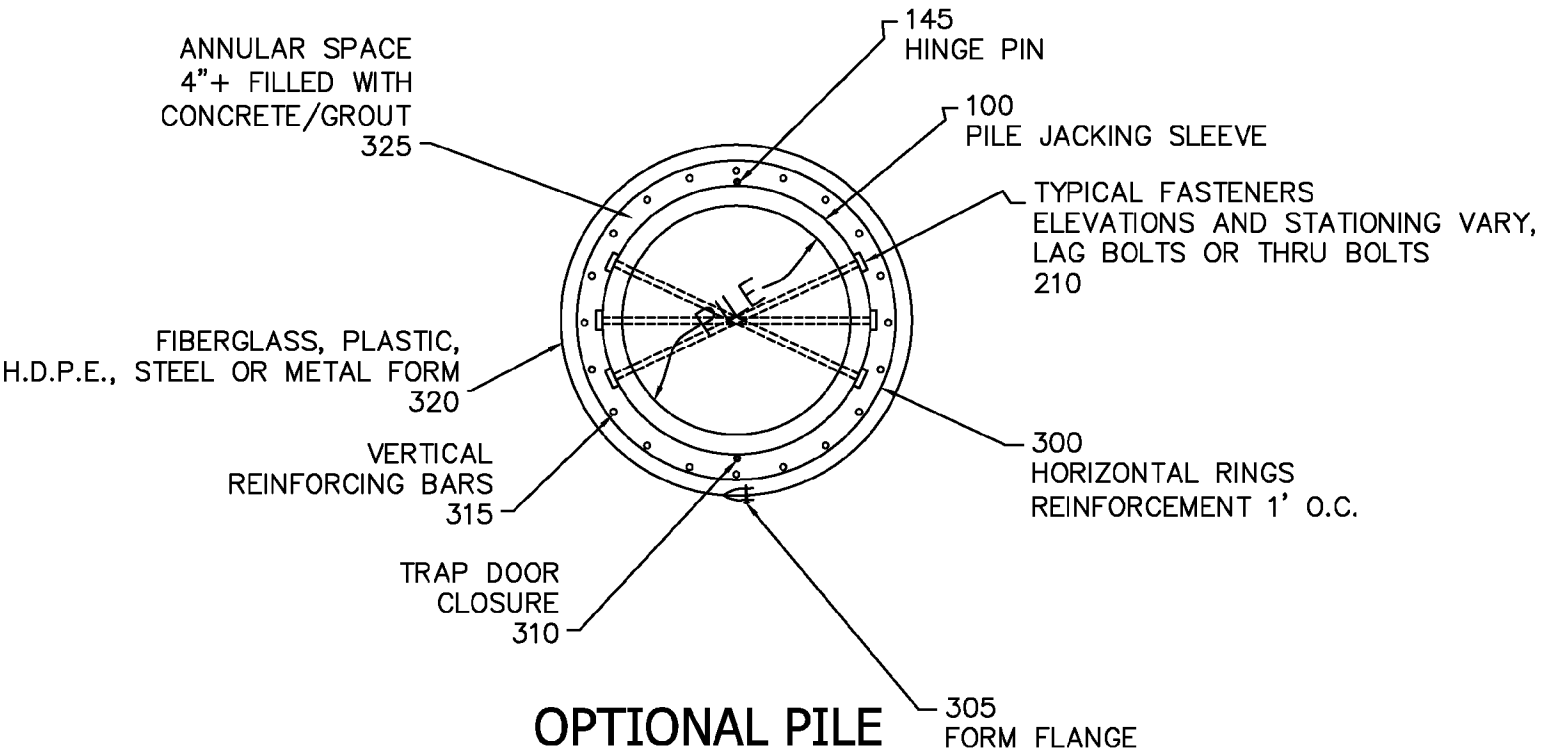
FIG. 3 is a top sectional view of an exemplary encased cylindrical pile jacking sleeve according to principles of the invention.

A hinged 145 door 120 with a closure 310 (as shown in FIG. 3) is provided in the top section 115, as a means for enabling lateral (i.e., horizontal) access by a new pile section. When the door 120 is open, the cut end of the new section of piling may be received laterally into the top section 115 of the sleeve. Thus, the bottom section 105 of the sleeve 100 may receive an existing or new bottom section of piling, while the top section 115 of the sleeve 100 may laterally receive a new top section of piling through the open door. Those skilled in the art will appreciate that the hinged door enables the sleeve to couple sections of piling, without dismantling or damaging the supported deck structure/super-structure. Those skilled in the art will further appreciate that one or more hinged doors (e.g., a pair of hinged doors) may be utilized without departing from the scope of the invention. Additionally, the hinged door 120 may pivot along a vertical hinged axis 145 in a conventional door-like manner or along a horizontal hinged axis in a drawbridge-like manner (not shown). Furthermore, other means for enabling lateral (i.e., horizontal) access such as removable panels may be utilized without departing from the scope of the invention.

A pair of plates 135 and 140 are also provided as pile support structures. A stationary plate 135 provides a stable base upon which the sleeve rests on a lower pile section and a jack may be placed. It also provides a surface for evenly distributing forces. The stationary plate, which may be welded or otherwise joined to the sleeve 100, partitions the bottom 105 from intermediate (i.e., jacking) 110 sections. When extended, the jack is supported by the stationary plate 135 and exerts compressive force against a floating plate 140, which provides a uniform, hard stable surface to exert and distribute upward forces against the bottom end of the top section of piling. Placing a jack surface directly against the bottom end of the top section of piling would risk damaging the piling. The floating plate 140 may move longitudinally in the sleeve and distributes concentrated jacking forces over the engaged section of the new upper pile. One or more stoppers (e.g., protrusions) may be provided to define a range of motion for the floating plate 140.

Figure 2:
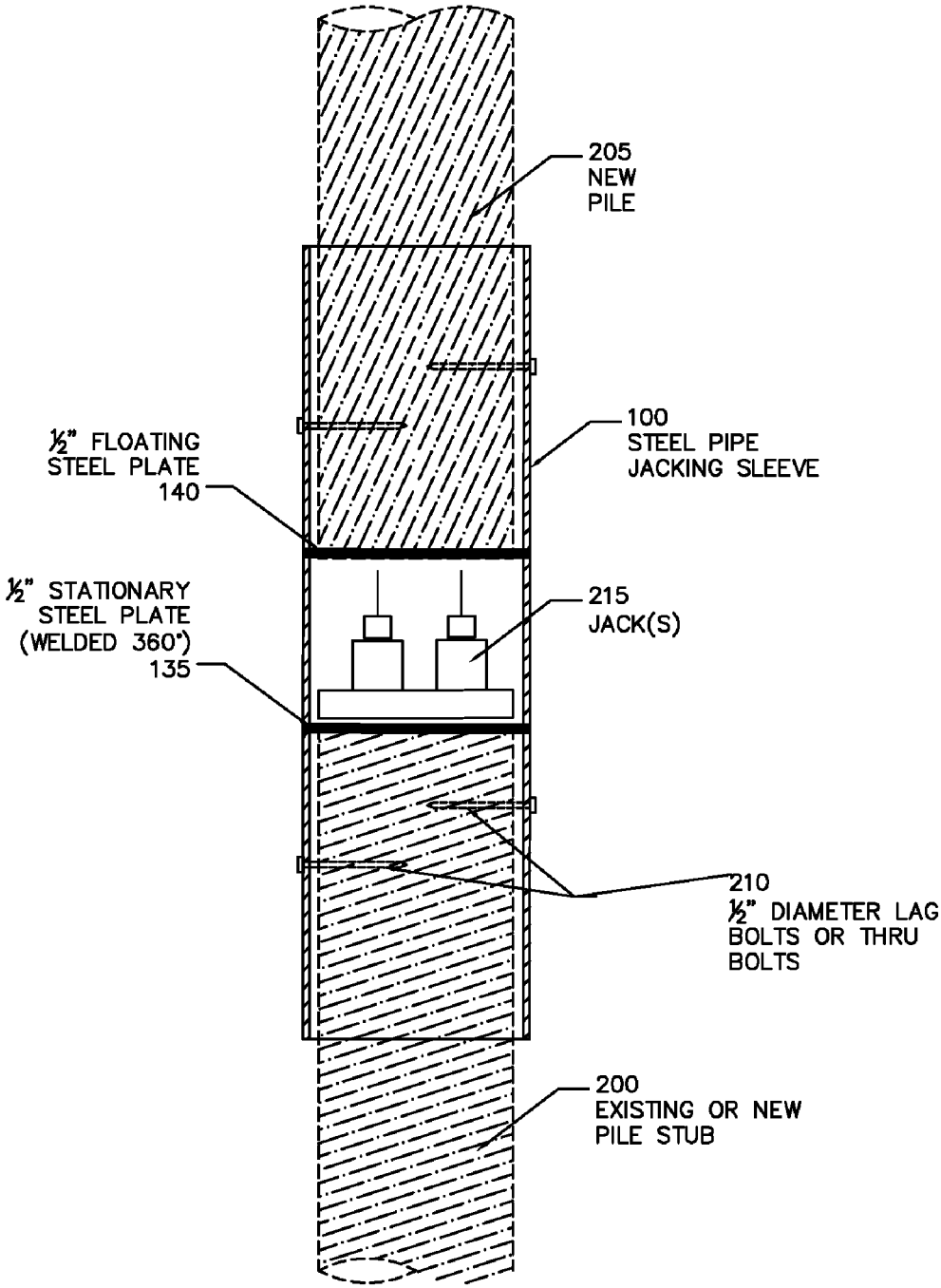
FIG. 2 is a profile view of an exemplary installed cylindrical pile jacking sleeve according to principles of the invention.

Referring now to FIG. 2, a side sectional view of an exemplary installed cylindrical pile jacking sleeve 100 according to principles of the invention is shown. An existing or new pile stub (i.e., bottom section of piling) 200 is received in the bottom section 105 of the sleeve. A plurality of lag bolts or thru bolts 210 secure the bottom section of the piling 200 to the sleeve 100. The stationary plate 135 rests atop the bottom section of the piling 200.

One or more jacks 215 are provided in the intermediate section 110 of the sleeve 100. Actuation of the jacks 215 forces the floating plate 140 upwardly, away from the stationary plate 135. The jacks 215 should be positioned and utilize a head that is conducive to even stress distribution and minimizes eccentricity between the jacks 215 and floating plate 140. One or more force or pressure measuring devices, such as calibrated hydraulic pressure gauges, may be operatively coupled to the jacks 215 to monitor the load. The jacks may be inserted (and optionally removed) through a window 150 (or a hinged door) in the intermediate section 110. As the sleeve 100 is structurally adequate to support the required load, including the new pile 205, the jacks 215 may be removed after the new pile 205 is secured to the sleeve. Alternatively, the jacks 215, which are typically considered expendable, may be left in place.

A new pile (i.e., top section of piling) 205 is received in the top section 115 of the sleeve 100. A plurality of lag bolts or thru bolts secure the top section of piling 205 to the sleeve 100, after the piling 205 has been loaded to a determined design load (i.e., a compressive load) by jacking. The top section of piling 205 rests atop the floating plate 140.

During installation, the pile jacking sleeve is first fitted onto the upper end of a bottom pile stub 200 and slid down along the bottom pile until the stationary plate 135 rests securely on top of the bottom pile stub 200. Next, the one or more jacks 215 are placed between the floating plate 140 and the stationary plate 135. Alternatively, the jacks 215 are placed between the floating plate 140 and the stationary plate 135 before the pile jacking sleeve is fitted onto the upper end of a bottom pile stub 200. Next, the hinged pile access door 120 is opened to receive the bottom end of the top (i.e., new) pile 205. The top pile 205 can then be maneuvered laterally into place through the opened hinged pile access door 120. When in place, the top pile 205 will extend approximately from the bottom of the supported deck structure/super-structure down to the floating plate 140. Laterally maneuvering the top pile 205 into place allows the new piling fit into any tight location, beneath a supported deck structure/super-structure, without having to dismantle or damage the supported deck structure/super-structure.

After the top and bottom piling 200, 205, jacks 215 and jack sleeve 100 are in place, the jacks 215 are actuated. Actuation may entail directly or indirectly applying hydraulic pressure or mechanical force to cause the jacks 215 to exert compressive force against the floating plate 140 and the top pile 205 supported thereon. Pile jacking force at any instant may be read from a load indicator operably coupled to the jacks 215, floating plate 140 and/or top pile 205. The jacks 215 are actuated until the exerted compressive force levels the supported deck structure/super-structure and/or the compressive force exerted reaches a design load for the supported deck structure/super-structure.

Once the desired compressive force is achieved, the top pile 205 may be locked into place. For example, a plurality of lag bolts or thru bolts may be used to secure the top section of piling 205 to the sleeve 100, after the piling 205 has been loaded to the determined design load (i.e., a compressive load) by jacking. As discussed above, the sleeve 100 is structurally adequate to support the required load, including the new pile 205. Therefore, the jacks 215 may either be removed after the new pile 205 is secured to the sleeve 100 or left in place as expendable support structures.

Referring now to FIG. 3, after the piling sections 200 and 205 are secured to the sleeve 100, the sleeve may optionally be encased in a conventional encasing manner for piling repairs. The encasement may be structural or non-structural. By way of example and not limitation, a rebar lattice comprised of vertical reinforcing bars 315 coupled by horizontal reinforcements 300 (collectively rebar) may be wrapped concentrically around the sleeve 100. Then a jacket 320 may be wrapped concentrically around the rebar 300 and 315. The ends of the jacket 320 may be secured together using a form flange 305 or other attachment (e.g., mechanical attachment, weld, or thermal or chemical bond). Spaces between the jacket 320, rebar 300 and 315 and piling 200 and 205 (e.g., annular space 325) may then be filled with an appropriate filler such as concrete, epoxy, cement and/or grout.

The filler may be introduced in a conventional manner for underwater construction. By way of example and not limitation, pressurized fluid filler may be pumped into the spaces between the jacket 320, rebar 300 and 315, jacketed portions of piling 200, 205, and other jacketed components using a suitable pump and conduit (e.g., a hose). Upon solidification, the jacket components are securely embedded in the resultantly formed strong, durable, protective filler material.

Figure 4:
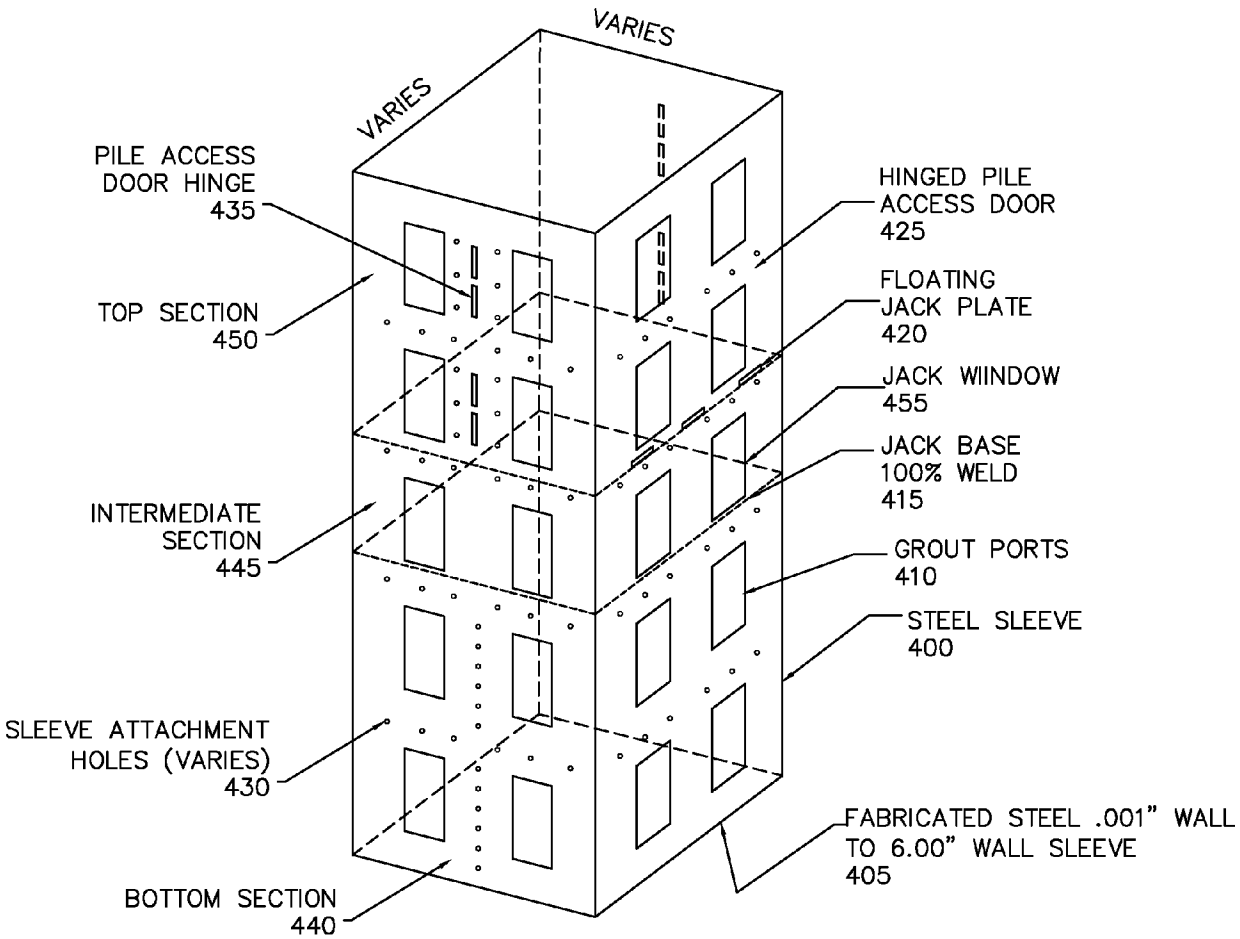
FIG. 4 is a perspective view of an exemplary pile jacking sleeve with a square/rectangular cross section according to principles of the invention.

Referring now to FIG. 4, a perspective view of an exemplary rectangular (e.g., square) pile jacking sleeve 400 is shown. The sleeve 400 includes a bottom section 440, an intermediate section 445 and a top section 450.

As a structural member, the sleeve 400 is designed to be at least as strong as the piling. In the exemplary embodiment illustrated in FIG. 4, the sleeve can support the weight of the top section of the piling plus the load that the piling was intended to carry. By way of illustration, without limitation, rectangular sleeves comprised of steel and having a consistent wall thickness of ¼ to 1 inch (or more) is considered adequate for most applications. Of course, the composition, shape and wall thickness may vary while still providing the requisite structural support and without departing from the scope of the invention.

The sleeve 400 is sized to engage rectangular or square piling sections. The sleeve 400 is sized slightly larger than the outer dimensions of the piling sections.

The sleeve includes a plurality of apertures. A plurality of bolt holes 430 are provided to receive bolts or other mechanical fasteners for securing the sleeve to the remaining sections of the piling or new installed piling. A plurality of grout windows 410 is also provided to allow grout (or other filler material) to fill the gap between the sections of the piling, between the piling and the sleeve and between the sleeve and an optional jacket. While the windows are displayed as rectangular openings, apertures having other shapes, sizes and proportions may be used. Additionally, at least one window 455 (or a hinged door) in the intermediate section 445 sized to allow one or more hydraulic jacks to be inserted and removed from the intermediate section 445 of the sleeve is also provided.

A hinged 435 door 425 is provided in the top section 450 to facilitate new pile installation. When the door 425 is open, the cut end of the new upper piling may be received laterally into the top section 400 of the sleeve. Thus, the bottom section 440 of the sleeve 400 may receive the cut end of the bottom section of the piling or new piling, while the top section 450 of the sleeve 400 may laterally receive the new upper piling through the open door. Those skilled in the art will appreciate that the hinged door enables the sleeve to couple pre-existing and/or new top and bottom pilings or sections of piling, without dismantling or damaging the supported deck structure/super-structure.

A pair of plates 415 and 420 are also provided. A stationary plate 415 provides a stable base upon which the sleeve rests on a lower pile section and a jack may be placed. It also provides a surface for evenly distributing forces. The stationary plate, which may be welded or otherwise joined to the sleeve 400, partitions the bottom 440 from intermediate (i.e., jacking) 445 sections. When extended, the jack is supported by the stationary plate 415 and exerts compressive force against a floating plate 420, which provides a uniform, hard stable surface to exert and distribute upward compressive force against the bottom end of the top section of piling. Placing a jack surface directly against the bottom end of the top section of piling would risk damaging the piling. The floating plate 420 may move longitudinally in the sleeve and distributes concentrated jacking forces over the cross-section of the new upper pile. One or more stoppers (e.g., protrusions) may be provided to define a range of motion for the floating plate 420.

Figure 5:
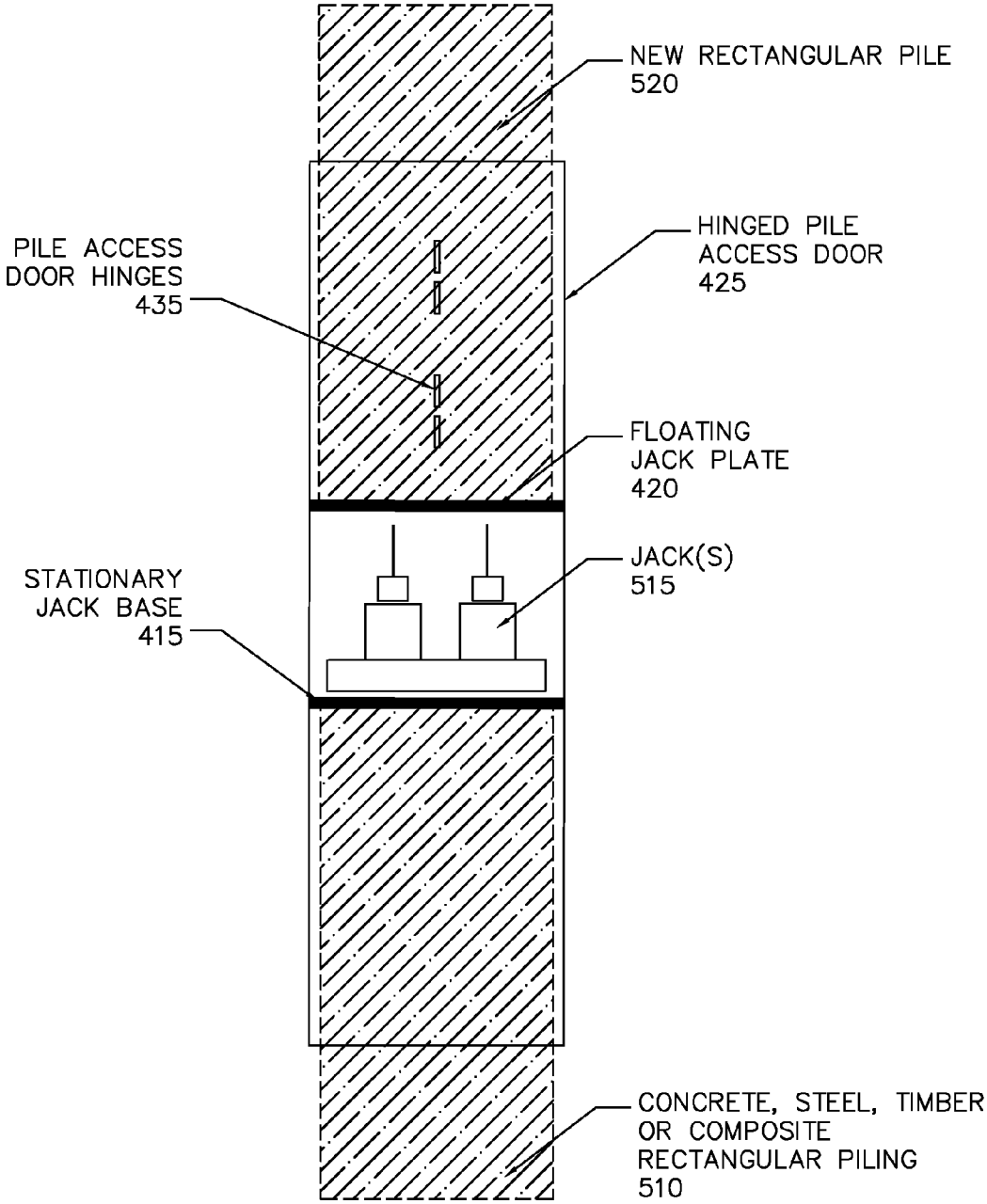
FIG. 5 is a profile view of an exemplary installed pile jacking sleeve with a square/rectangular cross section according to principles of the invention.
Figure 6:
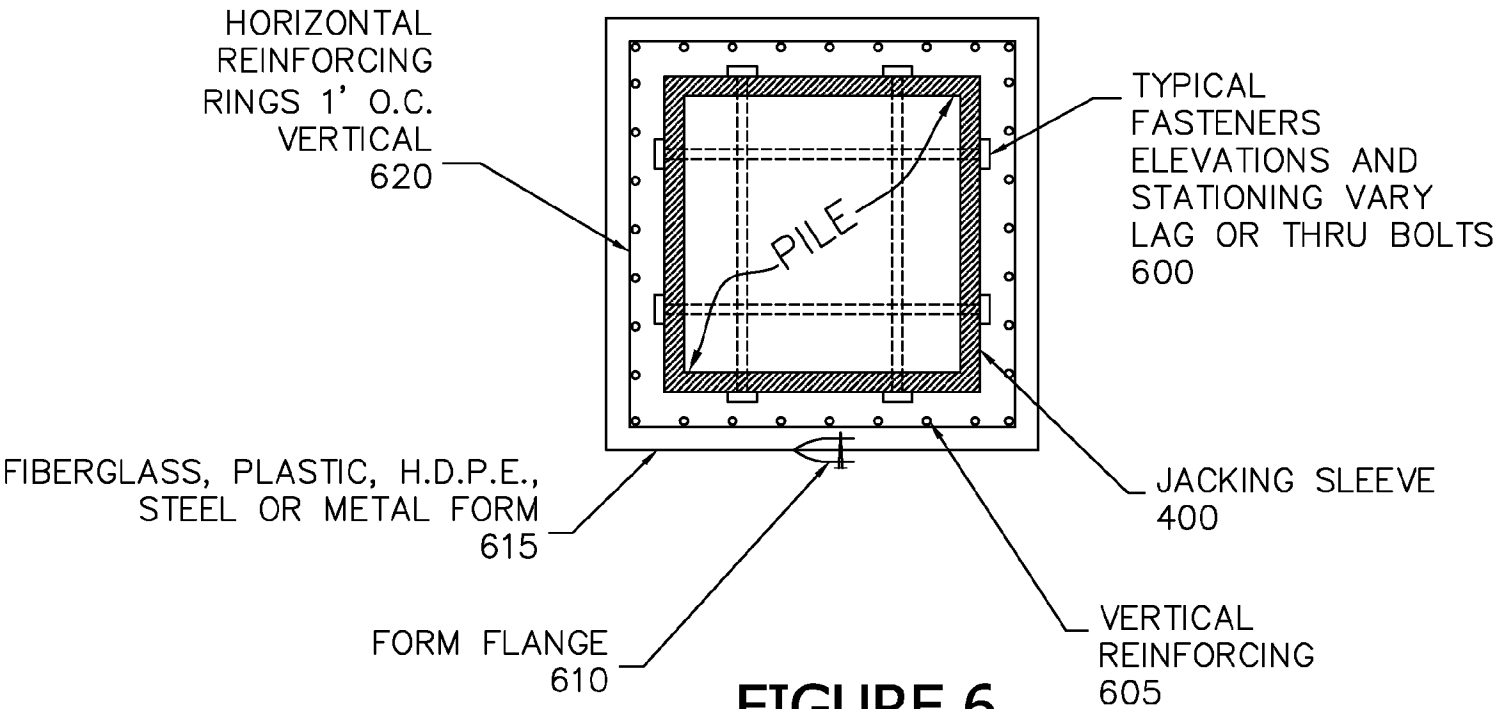
FIG. 6 is a top sectional view of an exemplary encased cylindrical pile jacking sleeve according to principles of the invention.

Referring now to FIG. 5, a side sectional view of an exemplary installed square/rectangular pile jacking sleeve 400 according to principles of the invention is shown. A portion 510 of an existing or new pile stub (i.e., bottom section of piling) 500 is received in the bottom section 440 of the sleeve. A plurality of lag bolts or thru bolts (e.g., bolts 600 as shown in FIG. 6) secure the bottom section of the piling 500 to the bottom section 440 of the sleeve. The stationary plate 415 rests atop the bottom section of the piling 510.

One or more jacks 515 are provided in the intermediate section 445 of the sleeve 400. Actuation of the jacks 515 forces the floating plate 420 upwardly. One or more force or pressure measuring devices, such as calibrated hydraulic pressure gauges, may be operatively coupled to the jacks 515 to monitor the load. The jacks may be inserted (and optionally removed) through a window (or a hinged door) in the intermediate section 445. As the sleeve 400 is structurally adequate to support the required load, including the new pile 520, the jacks 515 may be removed after the new pile 520 is secured to the sleeve. Alternatively, the jacks 515, which are typically considered expendable, may be left in place.

A new pile (i.e., top section of piling) 520 is received in the top section 450 of the sleeve 400. A plurality of lag bolts or thru bolts (e.g., bolts 600 as shown in FIG. 6) secure the top section of piling 520 to the top section 450 of the sleeve 400, after the piling 520 has been loaded to a determined design load by jacking. The top section of piling 520 rests atop the floating plate 420.

Referring now to FIG. 6, after the piling sections 510 and 520 are secured to the sleeve 400, the sleeve may be encased in a conventional encasing manner for piling repairs. Encasements may be structural or non-structural. By way of example and not limitation, a rebar lattice comprised of vertical reinforcing bars 605 coupled by horizontal reinforcements 620 (collectively rebar) may be wrapped concentrically around the sleeve 400. Then a jacket 615 may be wrapped concentrically around the rebar 620 and 605. The ends of the jacket 615 may be secured together using a form flange 610 or other attachment (e.g., mechanical attachment, weld, or thermal or chemical bond). Spaces between the jacket 615, rebar 620 and 605 and piling 500 and 520 may then be filled with an appropriate filler such as concrete, epoxy, cement and/or grout.

A pile jacking sleeve according to principles of the invention is not limited to any specific materials. Any materials suitable for marine construction, including, but not limited to, steel, galvanized steel, stainless steel, aluminum, other metals, alloys thereof, and composites may be utilized within the scope of the invention.

While the invention has been described in terms of various embodiments, implementations and examples, those skilled in the art will recognize that the invention can be practiced with modification within the spirit and scope of the appended claims including equivalents thereof. The foregoing is considered as illustrative only of the principles of the invention. Variations and modifications may be affected within the scope and spirit of the invention.

What is claimed is:

1. A unitary pile jacking sleeve comprised of:

a bottom sleeve section, an intermediate sleeve section and a top sleeve section, said bottom sleeve section, intermediate sleeve section and top sleeve section being adapted to structurally support a design load;

said bottom sleeve section having an open bottom end and a top end attached to said intermediate section, and said bottom section being adapted to receive through said open bottom end of said bottom section the top end of a bottom pile that has a bottom end secured in a ground;

said top sleeve section having an open top end and a bottom end attached to said intermediate section, and said top section being adapted to receive the bottom end of a top pile that extends from the open top end to a supported structure, and said design load being greater than the weight of the top pile; and said intermediate sleeve section being disposed between and adjoining said top sleeve section and said bottom sleeve section; and further comprising a floating plate separating the intermediate sleeve section from the top sleeve section.

2. A unitary pile jacking sleeve according to claim 1, further comprising an aperture in said intermediate sleeve section adapted for allowing insertion and removal of at least one jack into the intermediate sleeve section.

3. A unitary pile jacking sleeve according to claim 1, further comprising a plurality of fastener apertures in said pile jacking sleeve, said fastener apertures being adapted to allow mechanical fasteners to pass therethrough.

4. A unitary pile jacking sleeve according to claim 1, further comprising a plurality of filler apertures in said pile jacking sleeve, said filler apertures being adapted to allow filler material to pass therethrough.

5. A pile jacking sleeve comprised of:

a bottom sleeve section, an intermediate sleeve section and a top sleeve section, said bottom sleeve section, intermediate sleeve section and top sleeve section being adapted to structurally support a design load;

said bottom sleeve section having an open bottom end and a top end attached to said intermediate section, and said bottom section being adapted to receive through said open bottom end of said bottom section the top end of a bottom pile that has a bottom end secured in a ground;

said top sleeve section having an open top end and a bottom end attached to said intermediate section, and said top section being adapted to receive the bottom end of a top pile that extends from the open top end to a supported structure, and said design load being greater than the weight of the top pile; and said intermediate sleeve section being disposed between and adjoining said top sleeve section and said bottom sleeve section;

said top sleeve section further comprising means for enabling lateral access to said top sleeve section by the top pile, wherein said means for enabling lateral (i.e., horizontal) access to said top sleeve section by the top pile is comprised of a hinged door adapted for enabling lateral access to said top sleeve section by the top pile;

a stationary plate partitioning the bottom sleeve section from the intermediate sleeve section; and a floating plate separating the intermediate sleeve section from the top sleeve section.

6. A pile jacking sleeve according to claim 5, further comprising an aperture in said intermediate sleeve section adapted for allowing insertion and removal of at least one jack into the intermediate sleeve section.

7. A pile jacking sleeve according to claim 6, further comprising a plurality of fastener apertures in said pile jacking sleeve, said fastener apertures being adapted to allow mechanical fasteners to pass therethrough.

8. A pile jacking sleeve according to claim 7, further comprising a plurality of filler apertures in said pile jacking sleeve, said filler apertures being adapted to allow filler material to pass therethrough.

9. A pile jacking sleeve according to claim 8, further comprising at least one jack disposed between said stationary plate and said floating plate, and configured to enable urging said floating plate away from said stationary plate.

10. A pile jacking sleeve according to claim 9, further comprising a jacket surrounding said intermediate sleeve section, top sleeve section, and bottom sleeve section.

11. A pile jacking sleeve according to claim 10, further comprising a solidifying filler between said jacket and said intermediate sleeve section, top sleeve section, and bottom sleeve section.

12. A method of repairing a pile using a pile jacking sleeve according to claim 5, said method including:

sliding the bottom sleeve section down along the bottom pile until the stationary plate rests securely on top of the bottom pile;

opening the means for enabling lateral access to said top sleeve section by the top pile;

maneuvering the bottom end of the top pile laterally into place through the opened means for enabling lateral access until the bottom end of the top pile rests upon the floating plate;

exerting a compressive force against the floating plate to urge the floating plate away from the stationary plate until a determined compressive force is exerted onto the entire pile; and securing the top pile to the top section of the pile jacking sleeve after the determined compressive force is reached.

13. A method of repairing a pile according to claim 12, said method further including, encasing the pile jacking sleeve in an encasement and solidifying filler.

* * * * *